US005133155A

United States Patent [19]

Schwär

[11] Patent Number: 5,133,155

[45] Date of Patent: Jul. 28, 1992

[54] APPARATUS FOR GRINDING DISK FACES

[75] Inventor: Rudolf Schwär, Wuppertal, Fed. Rep. of Germany

[73] Assignee: Ernst Thielenhaus KG, Wuppertal, Fed. Rep. of Germany

[21] Appl. No.: 515,465

[22] Filed: Apr. 27, 1990

[30] Foreign Application Priority Data

May 4, 1989 [DE] Fed. Rep. of Germany ..... 3914720

[51] Int. Cl.[5] ..... B24B 7/00

[52] U.S. Cl. ..... 51/109 R; 51/111 R; 51/117; 51/118

[58] Field of Search ..... 51/80 R, 72 R, 109 R, 51/111 R, 237, DIG. 3, 117, 118, 281 SF, 217 T; 82/112

[56] References Cited

U.S. PATENT DOCUMENTS

| | | | |
|---|---|---|---|
| 1,978,674 | 10/1934 | Johnson | 51/118 |
| 3,721,046 | 3/1973 | Dunn | 51/118 |
| 4,417,422 | 11/1983 | Redeker et al. | 51/80 R |
| 4,592,169 | 6/1986 | Klievoneit et al. | 51/111 R |
| 5,040,338 | 8/1991 | Schwär | 51/DIG. 3 |

*Primary Examiner*—Bruce M. Kisliuk
*Assistant Examiner*—Lawrence Cruz
*Attorney, Agent, or Firm*—Herbert Dubno; Andrew M. Wilford

[57] ABSTRACT

An apparatus for grinding a disk having a center cup and a flat rim having a pair of opposite faces has a frame and an inner holder part rotatable relative to the frame about and displaceable on the frame along a holder axis and having a head formed with an outer holding face and with a central seat. An outer holder shaft rotatable relative to the frame and displaceable on the frame along the holder axis has an inner end turned toward the inner holder part and carrying a coupling in turn having an inner face and itself permitting biaxial movement between its inner face and the shaft. An outer holder part carried on the inner coupling face has a head formed with an inner holding face confronting the outer holding face and with a central projection engageable axially into the seat of the inner holder part. The inner and outer holder parts can be moved axially toward each other to clamp the center of the cup between the holding faces and to insert the outer-part projection into the inner-part seat. A gripper in the seat of the inner holder part engages the outer-part projection and pulls same axially into the inner part so that this the gripper can axially lock the holder parts together to clamp the disk center therebetween. Axially opposite grinding members are axially engageable with opposite faces of the disk rim as same is held in and rotated about the axis by the holder parts for grinding the opposite faces.

5 Claims, 7 Drawing Sheets

APPARATUS FOR GRINDING DISK FACES

FIELD OF THE INVENTION

The present invention relates to an apparatus for grinding the faces of a disk. More particularly this invention concerns a device for finish grinding a brake disk.

BACKGROUND OF THE INVENTION

A standard brake disk comprises a massive metallic element, typically of aluminum, having a center cup from which a flat rim projects radially. It is essential that the two faces of this disk be ground true to two parallel planes perpendicular to a center axis of the disk, which äxis is perpendicular to the floor of the center cup. Such disks, and similar machine parts of similar construction, are produced in large quantity by mass-production operations but, in spite of the large-volume production, must be made to very tight tolerances.

Accordingly it is standard to grip the disk in a holder which comprises a pair of axially spaced parts which can be rotated and at least one of which can be axially displaced between a holding position pressing the disk against the other element and a release position clear of the other element and allowing disks to be changed. At least one of these parts is driven and a pair of grinding stones adjacent the holder can be brought into axial engagement with opposite faces of the disk in the holder so as to fine-grind its faces as it and the holder rotate at high speed.

The actuator for the movable holder element or for both elements is maintained under pressure to clamp the disk tightly axially between the holder elements. Thus there is in effect a force loop having one side at the two holder elements and passing through the frame of the machine. In use the machine vibrates and is subject to considerable thermal expansion and contraction, so that the clamping force varies. This can lead to slipping of the disk and spoiling of it as it becomes canted between the stones. Furthermore the clamping force is applied to the bearings carrying the holder parts in the frame of the machine so that these bearings are subjected to considerable stress, shortening their service lives even when they are of very heavy-duty construction.

OBJECTS OF THE INVENTION

It is therefore an object of the present invention to provide an improved apparatus for grinding the faces of a disk.

Another object is the provision of such an improved apparatus for grinding the faces of a disk which overcomes the above-given disadvantages, that is which clamps the disk axially in the holder without subjecting the surrounding machine elements to intolerable stresses.

SUMMARY OF THE INVENTION

An apparatus according to the invention for grinding a disk having a center cup and a flat rim having a pair of opposite faces has a frame and an inner holder part rotatable relative to the frame about a holder axis and displaceable on the frame along the holder axis and having a head formed with an outer holding face and with a central seat. An outer holder shaft rotatable relative to the frame and displaceable on the frame along the holder axis has an inner end turned toward the inner holder part and carrying a coupling in turn having an inner face and itself permitting biaxial movement between its inner face and the shaft. An outer holder part carried on the inner coupling face has a head formed with an inner holding face confronting the outer holding face and with a central projection engageable axially into the seat of the inner holder part. The inner and outer holder parts can be moved axially toward each other to clamp the center of the cup between the holding faces and to insert the outer-part projection into the inner-part seat. A gripper in the seat of the inner holder part engages the outer-part projection and pulls same axially into the inner part so that this the gripper can axially lock the holder parts together to clamp the disk center therebetween. Axially opposite grinding members are axially engageable with opposite faces of the disk rim as same is held in and rotated about the axis by the holder parts for grinding the opposite faces.

Thus with this system the disk is wholly gripped right in the holder. There is therefore no stress applied to the frame and to the bearings carrying the holder parts. In addition the coupling or adapter in effect insulates the outer part of the holder from the frame so any vibration or thermal size changes are not transmitted to the holder; instead the clamping force remains entirely internal to the holder.

According to a feature of this invention the gripper includes a fluid-powered actuator and a plurality of gripping pawls. The projection of the outer part is formed with a radially open recess in which the pawls are engageable. This works like a shaft chuck.

Furthermore according to the invention the coupling has an inner element connected to the outer housing part, an outer element connected to the shaft, and elastomeric bumpers engaged axially and angularly between the inner and outer elements. Thus no stress is transmitted via the outer part to the machine frame or outer-part shaft. In addition the projection and seat are of complementary noncircular cross section and interfit to rotationally couple the housing parts.

With the system of this invention it is possible to bring the disk roughly into place with a loading device, then to position it very exactly with the holder. Subsequent grinding can therefore be very exact for a high-tolerance product. Disks of different axial dimensions can easily be handled by the same machine by adjusting the normally highly accurate actuators for the holder parts.

DESCRIPTION OF THE DRAWING

The above and other objects, features, and advantages will become more readily apparent from the following, reference being made to the accompanying drawing in which.

SPECIFIC DESCRIPTION

Figure 1:
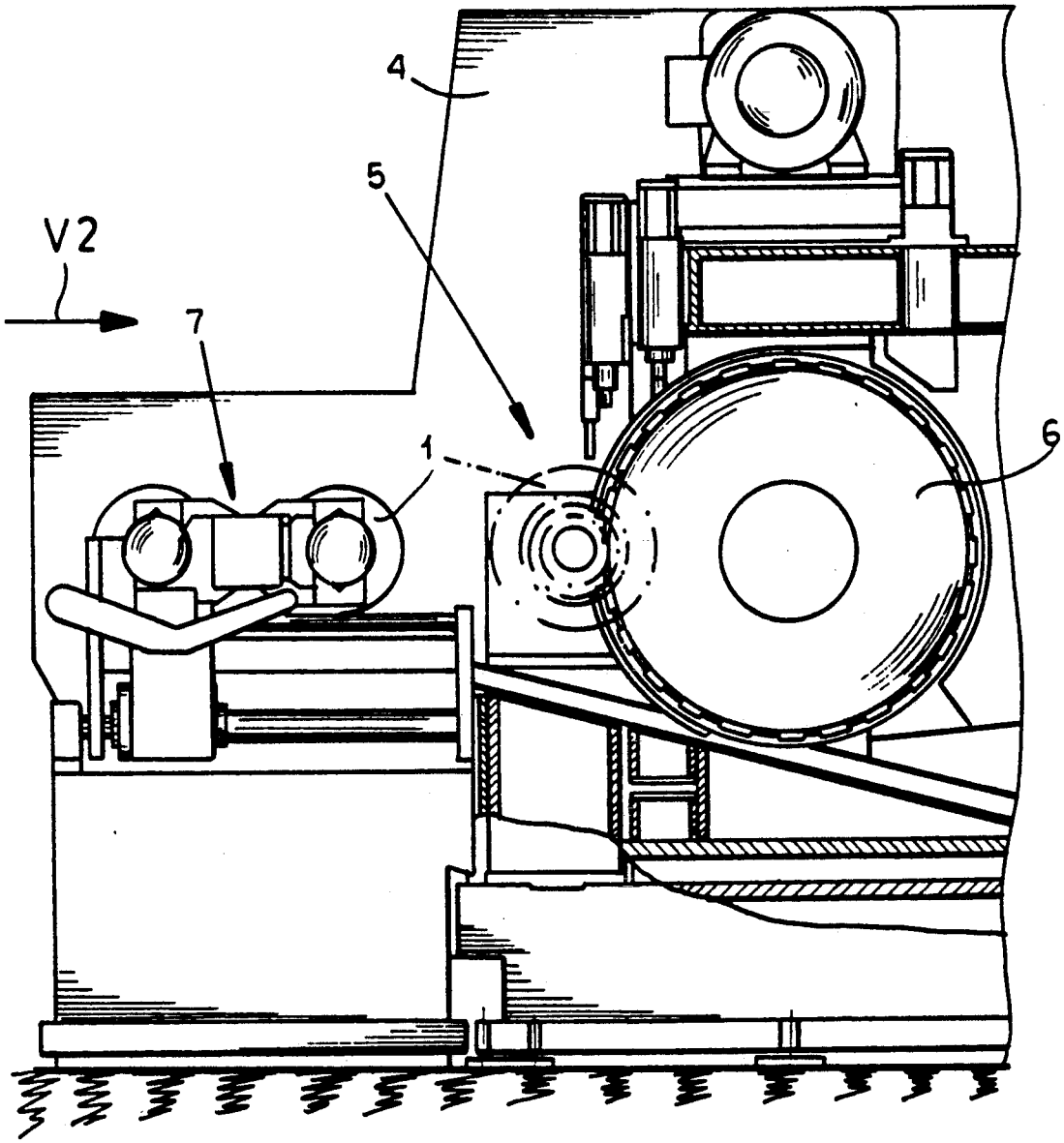
FIGS. 1 and 2 are small-scale side and end views of the apparatus according to this invention.
Figure 2:
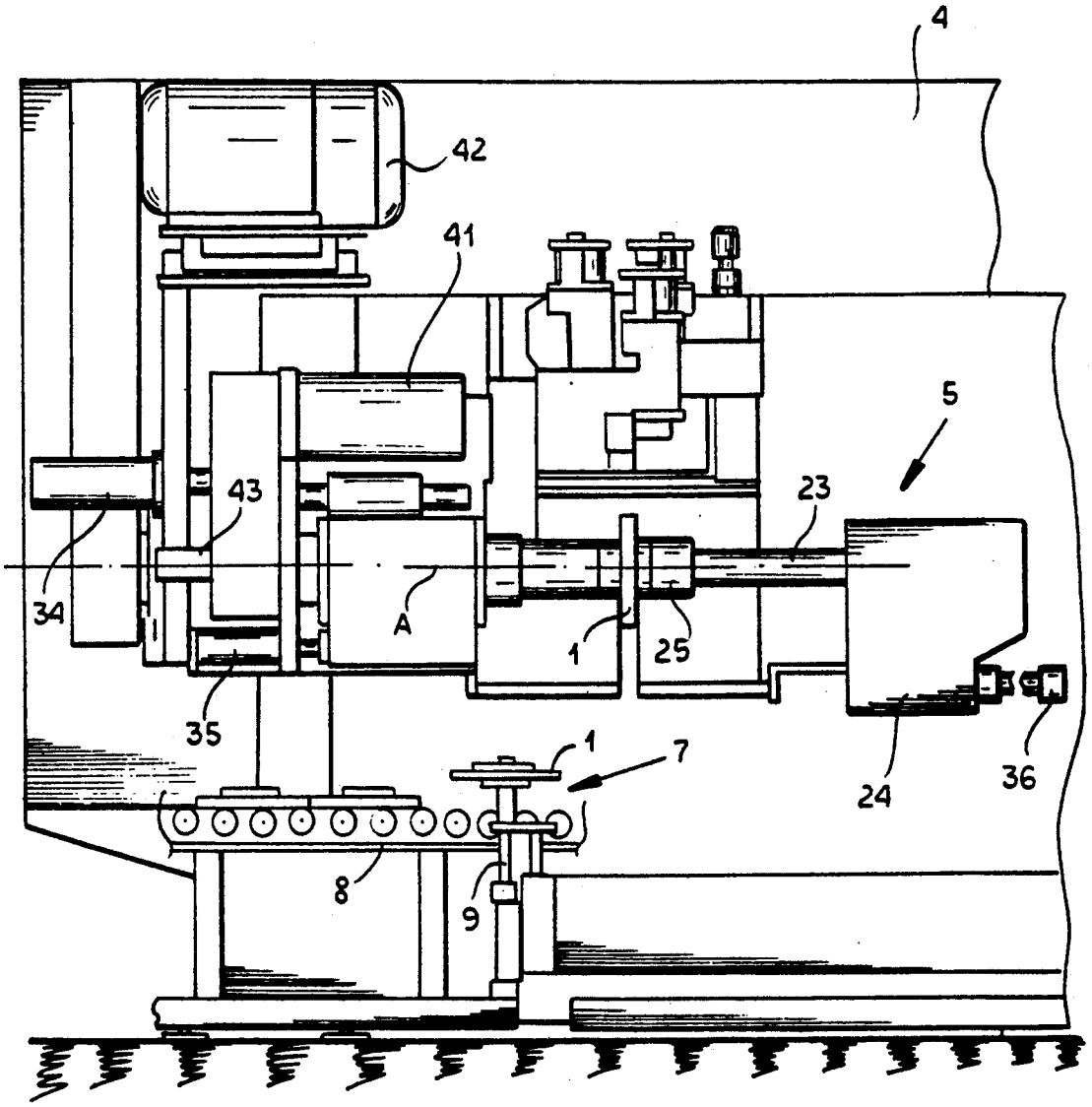

As seen in FIGS. 1 and 2 an apparatus for machining brake disks 1 basically comprises a frame 4 equipped with a holder 5 for centering each of the disks 1 on a horizontal axis A and rotating it thereabout while a pair of grinding wheels or stones 6 grind axially opposite faces of the held disk 1. Disks are supplied to the holder 5 by a supply device 7 having an input conveyor 8 and a height-equalizing device 9 which ensures that disks of different axial dimensions are fed to the holder 5 at the same level. The frame 4 carries actuators 35 and 36 for closing and opening the holder 5, a motor 41 for rotating the holder 5, actuators 34 for axially moving the stones 6 into contact with opposite faces of a held disk 1, and a motor 42 for rotating the stones 6. A controller 38 (FIG. 3) is connected to these various actuators and motors to operate them synchronously.

Figure 3:
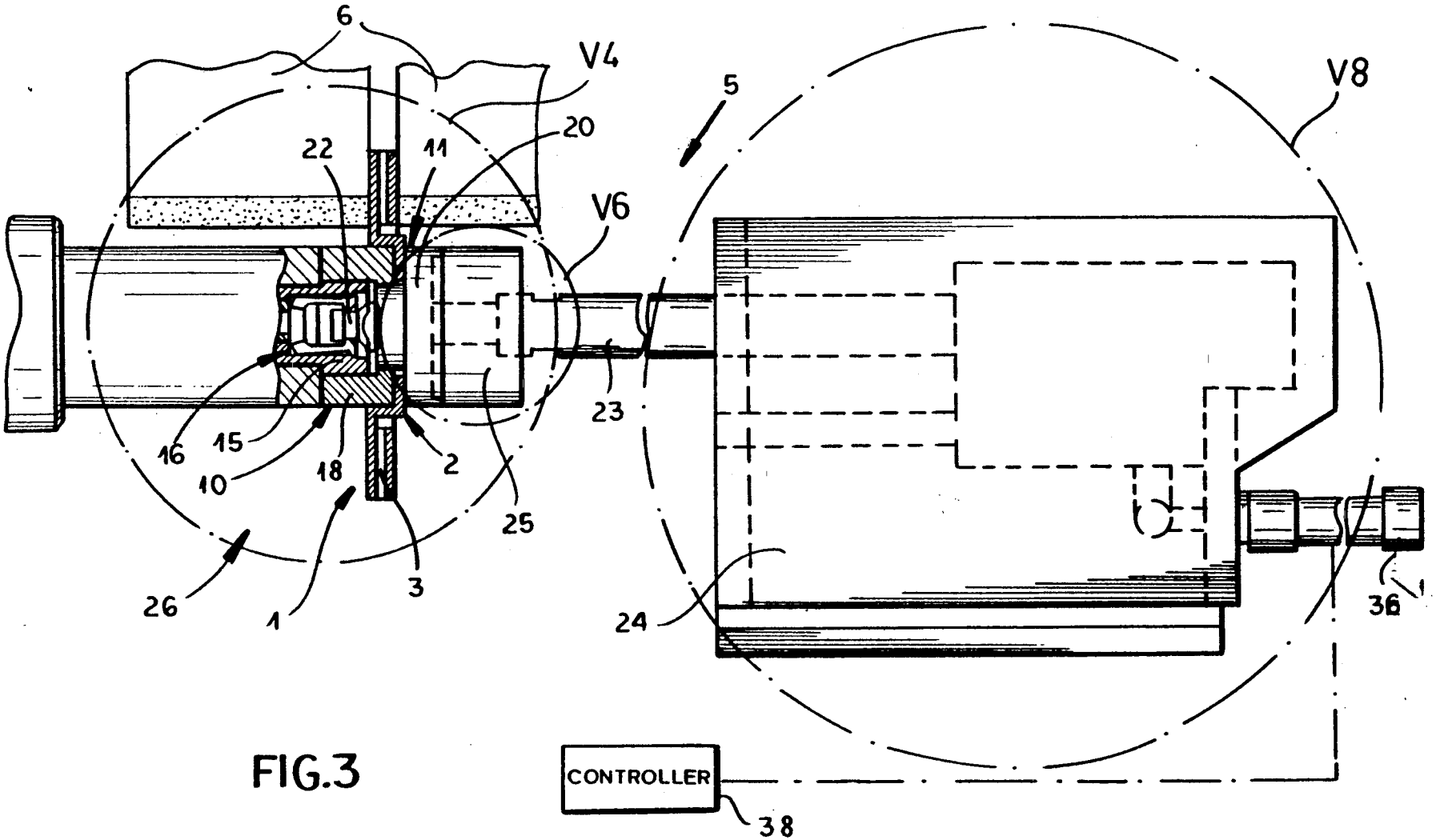
FIG. 3 is a large-scale view of a the holder assembly of FIG. 2.
Figure 4:
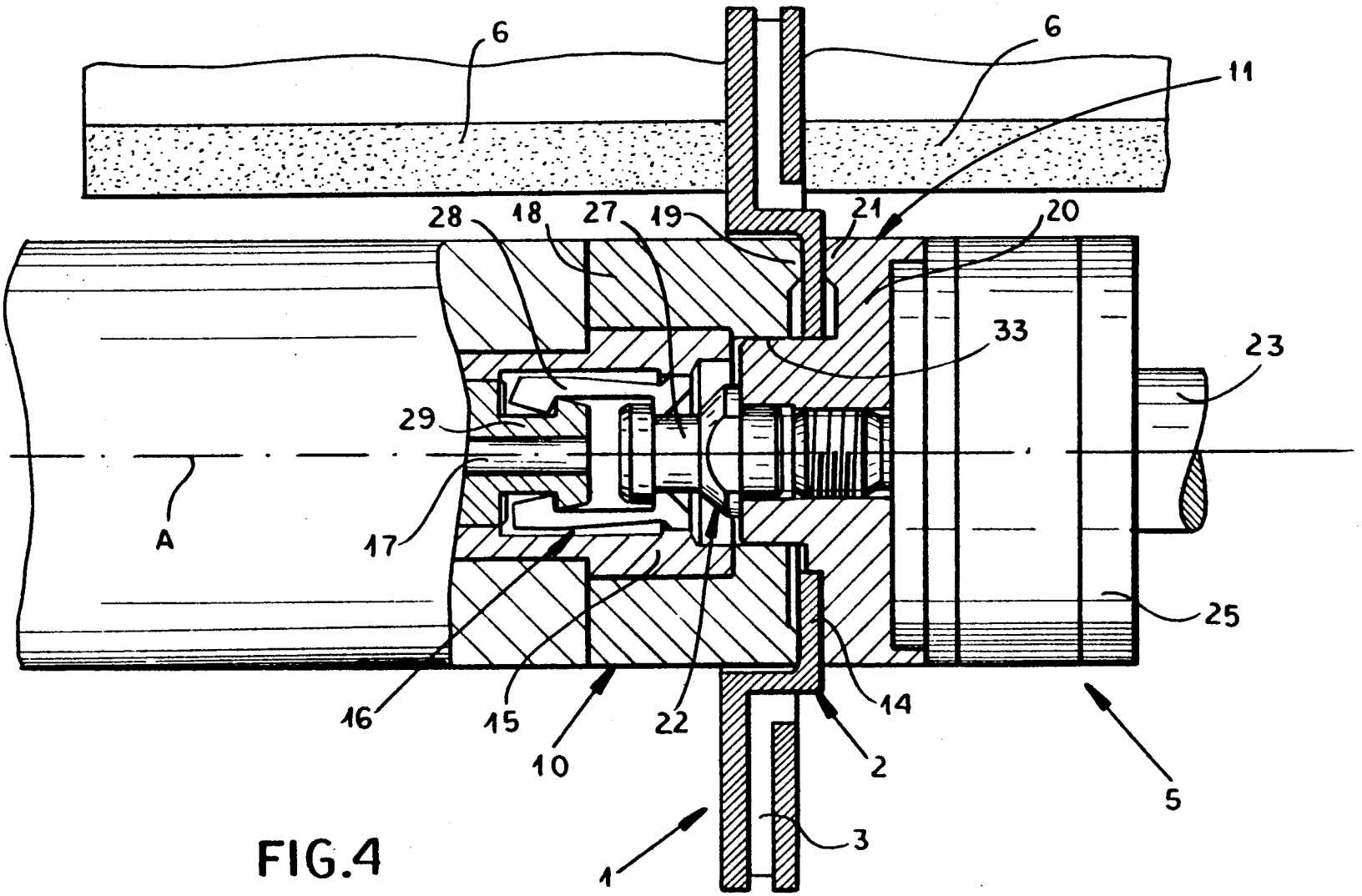
FIG. 4 is a large-scale view of the detail indicated at V4 in FIG. 3, the holder being shown in the closed position with the apparatus machining a disk.
Figure 5:
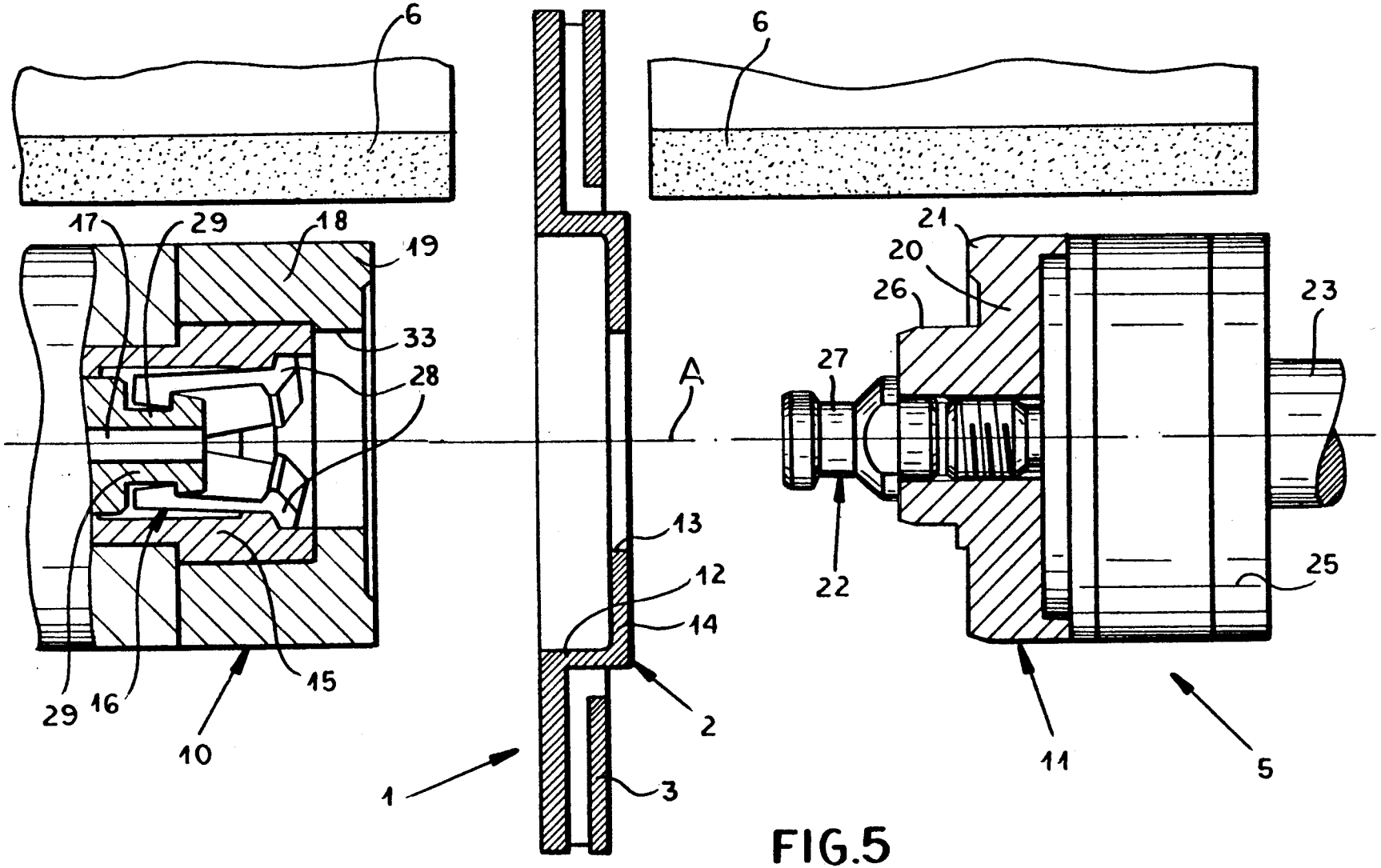
FIG. 5 is a view like FIG. 4 but showing the holder open.

As better seen in FIGS. 3, 4, and 5 the disk 3 comprises a center cup 2 centered on the axis A and a rim or flange 3 having axially oppositely directed planar faces perpendicular to the axis A. The cup 2 comprises a flat bottom 14 formed with a central throughgoing hole 13 and a cylindrical side wall 12 connecting the bottom 14 to the inner periphery of the annular rim 3.

The holder 5 basically comprises an inner part 10 and an outer part 11 shaped to complementarily engage at the cup 2 and lock on the disk 1 to hold it centered on the machining axis A. The part 10 has a tubular shaft 15 having an outer end carrying a gripper 16 and provided at this outer end with a head 18 having a triangular-section center hole 33 and a rim 19 of annular planar shape. The shaft 15 is rotated by the motor 41 and is axially displaced by the actuator 35. It is provided internally with another actuator shaft 17 having a grooved outer end 29 in which engage pawls 28 constituting the gripper 16 as will be described below. An actuator 43 like the cylinder 35 can limitedly axially reciprocate the shaft 17.

Figure 8:
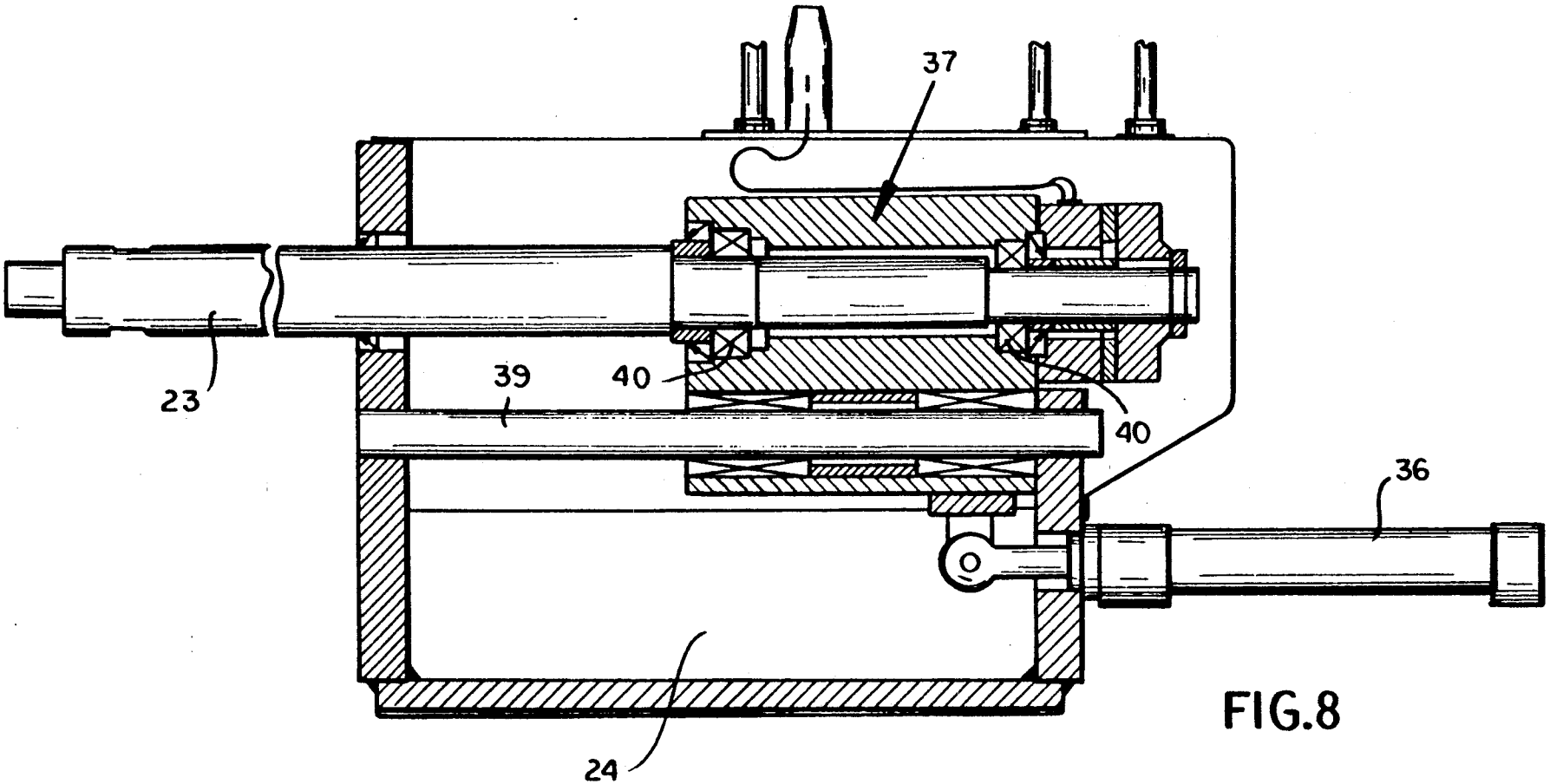
FIG. 8 is an axial section through the detail indicated at V8 in FIG. 3.

The outer part 11 is carried on a shaft 23 which as shown in FIG. 8 is carried by bearings 40 in a slide 37 itself axially displaceable along a guide 39 in a housing 24 by means of the actuator 36 that is operated synchronously with the actuator 35. The end of the shaft 23 is connected via a coupling 25 to a head 20 having an annular planar rim 21 like the rim 19. The center of the head 20 is formed with a triangular-section projection 26 complementary to the seat 33 and is provided centrally with an axially centered bolt 22 formed with a peripheral radially outwardly open groove 27 into which the front ends of the pawls 28 can engage.

Figure 6:
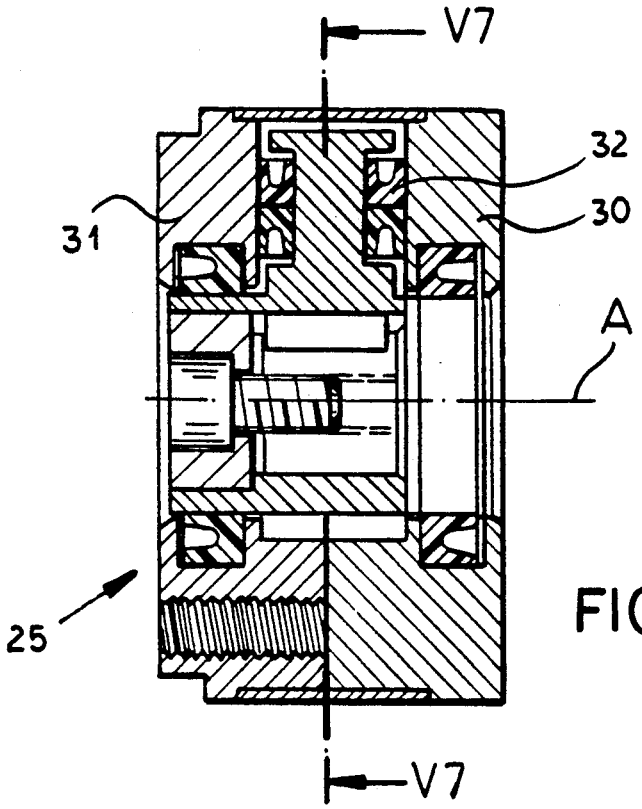
FIG. 6 is an axial section through the coupler of this invention.
Figure 7:
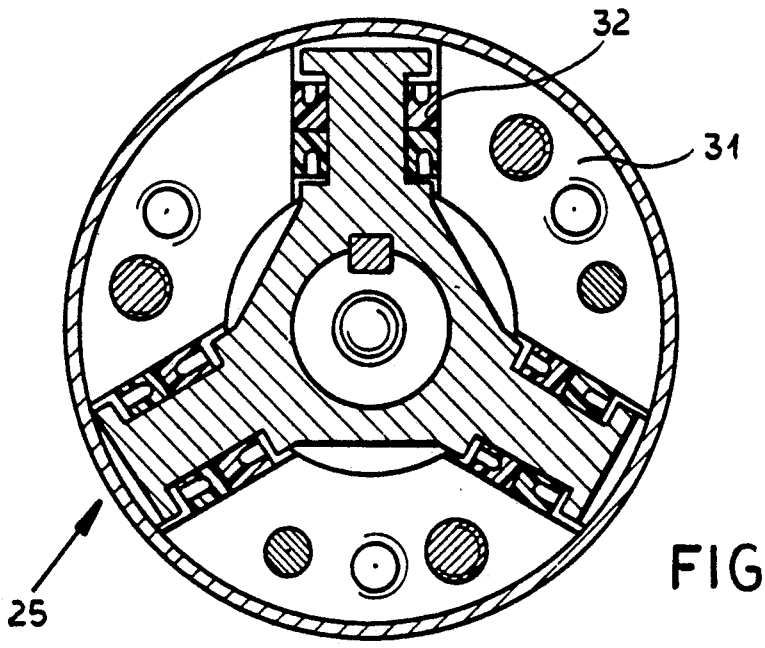
FIG. 7 is a sectional view taken along line V7—V7 of FIG. 6.

The coupling 25 as seen in FIGS. 6 and 7 comprises an outer part 30 that engages over the shaft 23 and a connecting part 31 for the head 20. Between the parts 30 and 31 are elastically deformable elements 32 that permit limited misalignment between the parts 30 and 31.

In use the holder 5 can be closed, moving from the FIG. 5 to the FIG. 4 position, on the cup 2 of a disk 1. As this occurs the projection 26 and bolt 22 pass through the hole 13 of the bottom 14 of the cup 2 and the projection 26 fits in the seat 33, rotationally locking the holder halves 10 and 11 together. Then the shaft 17 is retracted to the left in FIGS. 4 and 5 so as to fit the teeth at the ends of the pawls 28 into the groove 27 and thereby pull the halves 10 and 11 axially tightly together.

The force that maintains the parts 10 and 11 of the holder 5 tightly axially together therefore is not applied via the frame 4, but internally in the holder 5 itself. This ensures very solid clamping of the disk 1 with little radial stress to the bearings carrying the holder 5. The adapter 25 permits limited movement of the outer holder part 11 both perpendicular and parallel to the axis A so that if the frame 4 changes size slightly due to thermal expansion or contraction, this change can be compensated for by the elastomeric elements 32 without stressing the frame 4 or causing the disk 1 to get loose.

I claim:

1. An apparatus for grinding a disk having a center cup formed with a central hole and a flat rim having a pair of opposite faces, the apparatus comprising:

a frame;

an inner holder part rotatable relative to the frame about a holder axis and displaceable on the frame along the holder axis and having a head formed with an axially outwardly directed outer holding face and with a central set;

an outer holder shaft rotatable relative to the frame, displaceable on the frame along the holder axis, and having an inner end adjacent the inner holder part;

a coupling carried on the inner shaft end and having an axially inwardly directed inner face, the coupling permitting biaxial movement between its inner face and the shaft;

an outer holder part carried on the inner coupling face and having a head formed with a axially inwardly directed inner holding face axially confronting the outer holding face and with a central projection engageable axially into the seat of the inner holder part;

means for axially displacing the inner and outer holder parts toward each other to clamp the center cup between the holding faces and to insert the outer-part projection through the hole of the center cup into the inner-part seat;

gripper means in the seat of the inner holder part for engaging the outer-part projection and pulling same axially into the inner part, whereby the gripper means can axially lock the holder parts together to clamp the disk center cup therebetween;

drive means connected to at least one of the holder parts for rotating same and, when the disk is clamped between the holder parts, for rotating the disk about the axis; and means including axially opposite grinding members axially engageable with the opposite faces of the disk rim as the disk is held in the holder parts for grinding the opposite faces.

2. The disk grinding apparatus defined in claim 1 wherein the gripper means includes formations lockingly engageable with the outer-part projection, and a fluid-powered actuator connected to the formations for locking same on the outer-part projection and for axially inwardly displacing the formations when locked on the outer-part projection.

3. The disk grinding apparatus defined in claim 1 wherein the gripper means includes a plurality of gripping pawls constituting the formations, the outer-part projection being formed with a radially open recess in which the pawls are engageable.

4. The disk grinding apparatus defined in claim 1 wherein the coupling has an inner element forming the coupling inner face and connected to the outer holder part, an outer element connected to the shaft, and elastomeric bumpers engaged axially and angularly between the inner and outer elements.

5. The disk grinding apparatus defined in claim 1 wherein the outer-part projection and inner-part seat are of complementary noncircular cross section and interfit to rotationally couple the holder parts.

* * * * *